US008162361B2

(12) United States Patent
Biddington

(10) Patent No.: US 8,162,361 B2
(45) Date of Patent: Apr. 24, 2012

(54) FIRE POKER

(76) Inventor: Dale Biddington, New Brunswick (CA)

( * ) Notice: Subject to any disclaimer, the term of this patent is extended or adjusted under 35 U.S.C. 154(b) by 142 days.

(21) Appl. No.: 12/390,768

(22) Filed: Feb. 23, 2009

(65) Prior Publication Data

US 2009/0315351 A1 Dec. 24, 2009

(51) Int. Cl.
*F24B 15/00* (2006.01)

(52) U.S. Cl. ..... 294/14; 294/26

(58) Field of Classification Search ..... 294/14, 294/24, 10, 11, 26; 7/109; 30/322, 349; D7/683; D8/14, 51; D23/403
See application file for complete search history.

(56) References Cited

U.S. PATENT DOCUMENTS

| | | | | | |
|---|---|---|---|---|---|
| 481,763 | A | * | 8/1892 | Johnson | 140/102.5 |
| 897,293 | A | * | 9/1908 | Korpl | 7/109 |
| 2,326,676 | A | * | 8/1943 | Peters | 294/11 |
| 2,739,330 | A | * | 3/1956 | Hitchcock | 294/24 |
| D248,209 | S | | 6/1978 | Holleman | |
| D258,342 | S | * | 2/1981 | Boulis et al. | D8/14 |
| D267,999 | S | | 2/1983 | Rhoades | |
| 4,574,512 | A | | 3/1986 | Hahn | |
| 5,593,196 | A | * | 1/1997 | Baum et al. | 294/19.1 |
| 6,798,348 | B1 | * | 9/2004 | Wilker et al. | 340/691.1 |
| D504,934 | S | | 5/2005 | Amburgey | |
| D528,879 | S | * | 9/2006 | Ferrara et al. | D8/14 |
| 7,131,675 | B1 | | 11/2006 | Loucks | |

OTHER PUBLICATIONS

Rishel, Campfire Possibilities LLC, http://www.campfirepossibles.com/web/CampingTools/FirePoker/54/, 2007, 1 pg.

FireplaceScreen Showcase, "27 Inch Black Fire Poker in Wrought Iron", http://www.fireplacescreenshowcase.com/fire-Poker-27.htm, 2003-2009, 2 pgs.

* cited by examiner

*Primary Examiner* — Paul T Chin

(74) *Attorney, Agent, or Firm* — McDermott Will & Emery LLP

(57) ABSTRACT

A fire poker is provided which is comprised of an elongate shaft, a handle at one end of the shaft and a longitudinal hook member near the second end of the shaft. The shaft has a bend located at a position between the handle and the hook member. Alternatively, the shaft may have a plurality of bends located at positions between the handle and the hook member. The plurality of bends divides the shaft into a plurality of sections, and the section of the shaft that contacts the hook member is preferably in the same plane as the section that contacts the handle. The at least one bend in the shaft of the fire poker provides for a device that is more comfortable to wield, is better from an ergonomic perspective and allows for considerably easier manipulation of the fuel of a fire.

16 Claims, 3 Drawing Sheets

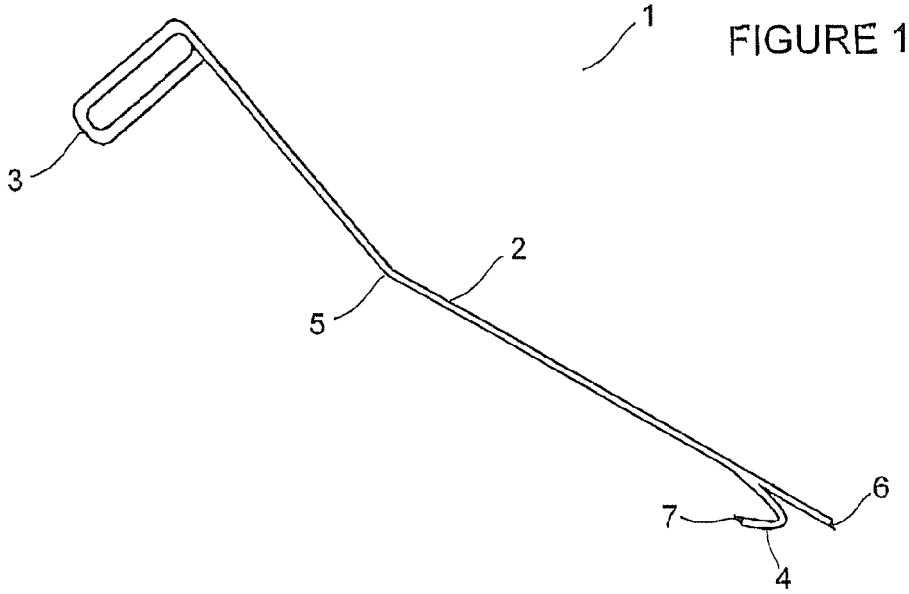
FIGURE 1
FIGURE 2
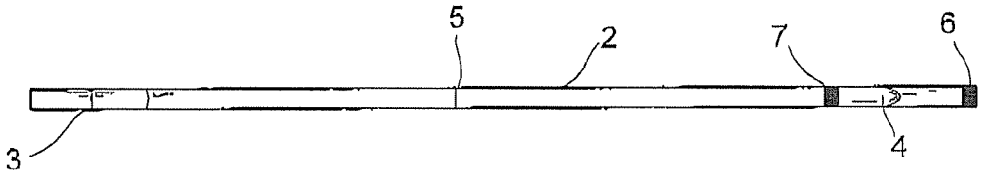
FIGURE 3
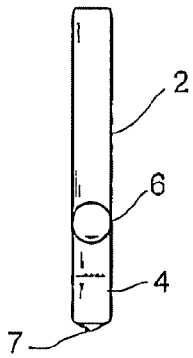

FIRE POKER

RELATED APPLICATION

This application claims priority to Canadian Application No. 2,635,194 filed Jun. 18, 2008, the entirety of which is incorporated herein by reference.

FIELD OF THE INVENTION

The invention relates to fire pokers. In particular, the invention relates to fire pokers that are designed to allow for easier manipulation of the fuel of a fire.

BACKGROUND OF THE INVENTION

A fire poker (also known as a "stoker") is a short, rigid rod, preferably of fireproof material, used to adjust coals and/or wood fuel, burning in a fireplace or a firepit. It is often metallic and sometimes has a point at one end for pushing burning materials (or a hook for pulling/raking, or a combination thereof) and a handle at the opposite end.

An example of a fire poker as found in the prior art can be seen in U.S. Pat. No. 7,131,675. This fire poker has a hook portion attached at one end of a shaft, with a handle at the opposing end. The handle incorporates such features as a directional compass and an aperture to hang the poker. Although this poker has a straight segment that extends past the hook portion by about one inch, this distance is not significant enough to allow for the straight segment to be utilized for stoking a fire without having the hook portion interfere with the process. Furthermore, the nature of the shaft of the fire poker will typically result in the fire being stoked in essentially a downward direction. This makes the manipulation of the fuel of the fire substantially more difficult, and extra energy is required to be expended by the user in order to stoke the fire in a satisfactory manner.

U.S. Design Pat. No. 248,209 illustrates a fireplace poker that has an elongate shaft with a hook member disposed near the very end of the shaft. At the opposing end, there appears to be a wooden handle attached thereto. In this design, the hook member is located so close to the tip of the shaft that manipulation of the fuel of the fire with the tip of the shaft independent of the hook, or the hook independent of the tip, becomes essentially impossible. In essence, what should be a device with two distinct means for maneuvering the fuel of a fire, is instead relegated to essentially only a single means. Also, the nature of the shaft of the poker will result in the fire being stoked in essentially a downward direction, as the user will typically be in an elevated position with respect to the fire. This angle provides for less efficiency when manipulating the fire, and delicate displacement of, e.g. logs of the fire, becomes difficult. Akin to this, fire pokers of this design are considerably less ergonomic.

U.S. Design Pat. No. 267,999 illustrates a fire poker that has an elongate shaft. One end of the shaft has what appears to be a wooden handle attached thereto. The opposing end of the shaft is curled around to form a hook member. At the same end of the shaft, but on the side opposing the hook member, another hook member extends from the shaft. The first hook member points back in substantially the same direction as the handle, whereas the second hook member points in substantially the opposite direction of the handle. With this configuration, any manipulation of the fuel of the fire will always tend to be in the downward direction, unless the user has lowered themselves to the level of the fire. Also, the handle appears to be an extraneous piece which has mere been attached to the shaft after the poker has been molded/forged. This provides for instances where the handle may fall off or break off from the shaft, making the poker considerably more difficult to wield.

SUMMARY OF THE INVENTION

It is an object of the present invention to provide a fire poker which addresses the deficiencies as found in the prior art.

According to an aspect of the present invention, there is provided a fire poker comprising a generally elongated body portion, a handle adapted to co-operate with the body portion and facilitate the manipulation and control thereof; the handle being disposed in the general vicinity of one end of the body portion; a structure which is adapted, shaped and dimensioned so as to facilitate the control and maintenance of the fire and selected arrangement of components thereof, the structure being adapted for co-operation with the body portion in a position remotely disposed from the handle; wherein the normally elongated extension of the body portion deviates tangentially at a selected juncture along its length to a degree sufficient to facilitate and enhance the efficient operation and control thereof.

According to another aspect of the present invention, there is provided a fire poker comprising an elongate shaft, a handle at one end of the shaft, a longitudinal hook member near the second end of the shaft, wherein the shaft has a bend located at a position between the handle and the hook member, such that the hook member extends away from the handle.

According to various embodiments of the present invention, the bend can be located closer to the handle than to the hook member, closer to the hook member than to the handle or substantially at the midpoint between the hook member and the handle.

According to another embodiment of the present invention, the hook member has a rounded "V" shape. It is preferred that the apex of the rounded "V" shaped hook member is located from about 1 inch to about 7 inches from the tip of the second end of the shaft. Additionally, in yet another embodiment, the end of the hook member points substantially in the direction of the handle, and the bend causes the handle to extend away from the hook member.

In a further embodiment of the present invention, the handle is "D" shaped or "U" shaped. The handle and the hook member can be located on the same side of the shaft, and it is possible that the handle is in the same plane as the hook member. Typically the handle can be molded or forged to the shaft, moreover, it is contemplated that the entire fire poker is of a single unitary construction.

In a still further embodiment of the present invention the bend is angled in the range of about 10° to about 60°. It is also envisioned that the tip of the second end of the shaft and the tip of the end of the hook have an angled tapered finish, where the tapered finish is angled at 45°. Alternatively, the tip of the second end of the shaft and the tip of the end of the hook may be pointed.

In still yet another embodiment, the cross section of the poker may be square, rectangular, triangular, elliptical or circular. Preferably the poker is made of round cold roll steel.

Preferably a portion of the poker has a fluorescent colour. In particular, it is preferred that at least the handle portion of the poker has a fluorescent colour.

According to yet another aspect of the present invention, there is provided a fire poker comprising an elongate shaft, a handle at one end of the shaft, a longitudinal hook member near the second end of the shaft, wherein the shaft has a plurality of bends located at positions between the handle and the hook member, where the plurality of bends divide the shaft into a plurality of sections, and the section of the shaft that contains the hook member is in the same plane as the section of the shaft that contains the handle and the section of the shaft that contains the hook member extends away from the section of the shaft that contains the handle.

In an embodiment of the present invention, the section of the shaft that contacts the handle and the section of the shaft that contacts the hook member are substantially parallel.

Preferably, the hook member has a rounded "V" shape, and the apex of the rounded "V" shaped hook member is located from about 1 inch to about 7 inches from the tip of the second end of the shaft.

In another embodiment of the present invention, the end of the hook member points substantially in the direction of the handle. Preferably, the handle is "D" shaped or "U" shaped. It is also preferred that the handle and the hook member are located on the same side of the shaft. The handle is preferably in the same plane as the hook member, and it is especially preferred that the handle is molded or forged to the shaft, moreover it is possible that the fire poker is of a single unitary construction.

In a further embodiment of the present invention, the plurality of bends are each independently angled in the range of about 10° to about 90°.

It is preferred that the tip of the second end of the shaft and the tip of the end of the hook have an angled tapered finish. In particular, the tapered finish is angled at 45°.

Alternatively, the tip of the second end of the shaft and the tip of the end of the hook are pointed.

Preferably the cross section of the poker is square, rectangular, triangular, elliptical or circular. It is also preferred that poker is made of round cold roll steel.

It is especially preferred that at least a portion of the poker has a fluorescent colour, and in particular, that at least the handle portion of the poker has a fluorescent colour.

BRIEF DESCRIPTION OF THE DRAWINGS

Embodiments of the present invention will be described in detail with reference to the Drawings in which:

FIG. 1 is a side elevation view of an aspect of the present invention;

FIG. 2 is a front view of an aspect of the present invention;

FIG. 3 is a bottom plan view of an aspect of the present invention;

DETAILED DESCRIPTION OF THE INVENTION

Figure 4:
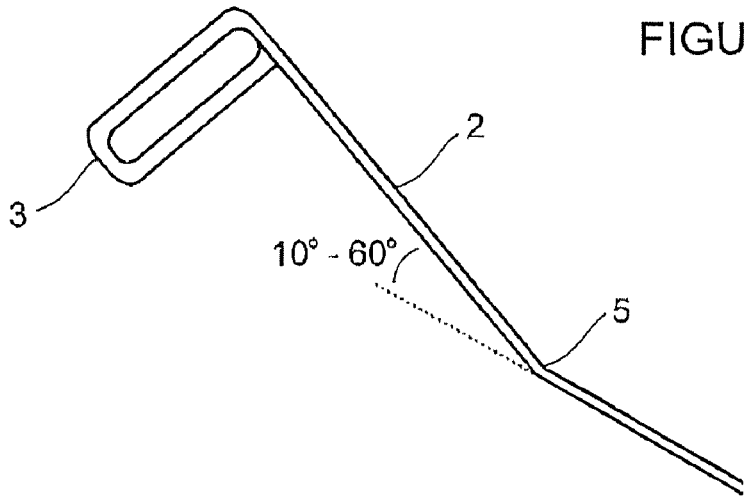
FIG. 4 is a side elevation view illustrating an embodiment of the present invention.

As used in the specification as well as in the appended claims, the term "about" is utilized to modify various numerical values. In this context, the term "about" should be construed to mean any value that is within 10% of the stated value. For example, if the term "about" is used to modify a value of 20°, then the value should then be interpreted as representing the range of 18° to 22°, that is, the value +/−10%.

FIGS. 1, 2 and 3 illustrate a preferred embodiment of the fire poker 1 of the present invention. The fire poker 1 comprises a shaft 2, a hook member 4 extending longitudinally from one end of the shaft 2, and a handle 3 at the opposing end of the shaft 2.

The poker 1 as illustrated in FIG. 1 has a bend 5 in the shaft 2. The bend 5 can occur anywhere along the length of the shaft 2, i.e. anywhere in the shaft 2 spanning the length between the handle 3 to the hook member 4. Preferably the shaft 2 is bent at an angle in the range of about 10° to about 60°. More preferably, the shaft 2 is bent at about 20°. Having the shaft 2 bent within this specified range of angles allows for easier manipulation of the fuel of a fire. Although the user will typically be elevated in relation to the fire, the bend 5 assures that the fire will not be agitated in essentially a downward direction. Rather, when the handle 3 of the poker 1 is comfortably within the users grasp, the portion of the shaft 2 which contains the hook member 4 will be substantially closer to the horizontal, which provides for significantly greater ease of use with regard to the manipulation of the fuel of a fire. The inclusion of the bend also serves to provide leverage when twisting the poker 1. Hence it appears as though less torque is required for selected types of log manipulation. This can result in less expended energy by the user, and less strain imposed on the arm and/or wrist of the user.

Figure 8:
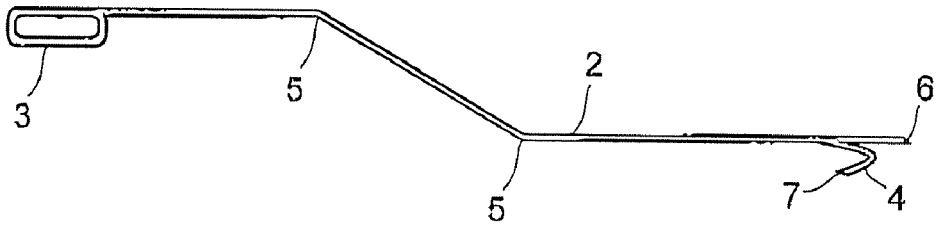
FIG. 8 is a side elevation view of another aspect of the present invention.

It is also envisioned that the fire poker 1 of the present invention could have more than one bend 5. An example of a fire poker 1 comprising more than one bend 5 within its shaft 2 is illustrated in FIG. 8. Similar to the poker 1 as illustrated in FIG. 1, this poker 1 also has a shaft 2, a hook member 4 extending longitudinally from one end of the shaft 2, and a handle 3 at the opposing end of the shaft 2. This Figure depicts a poker 1 where the shaft 2 has two bends, however, it is contemplated within the scope of the present invention that more than two bends could also be incorporated into the shaft 2. The plurality of bends 6 in the shaft 2 can be bent at any angle, independently of each other, which, when the handle 3 is comfortably resting in the user's hand, results in the portion of the shaft 2 containing the hook member 4 being substantially closer to the horizontal, than if the shaft 2 itself contained no bends 5. The bends being thus described will provide for a fire poker 1 which is more ergonomic and which can more easily manipulate and adjust the fuel, e.g. logs and/or coals, of a fire. Accordingly, these angles can be computed by a man of ordinary skill in the art. However, preferably the plurality of bends are each independently angled in the range of about 10° to about 90°.

The fire poker 1 can be molded or forged out of a variety of compounds, with the main characteristics being that the material should be sturdy and solid, should not be flammable or combustible and should not efficiently transmit heat. Preferable materials are steel, such as stainless steel, and iron. The thickness of the material that is chosen can be varied, and various thicknesses are envisioned, which can accommodate the differences in the end users hand size. This will allow for the user to comfortably grasp and wield the fire poker 1. It is preferable that the poker 1 has a smooth finish, however, it is also contemplated that the poker 1 could have a square cross section, a rectangular cross section, a triangular cross section, an elliptical cross section or a circular cross section. However, any type of cross section of the fire poker 1 would fall within the scope of the present invention. In addition, the poker 1 could be forged/molded to have a braided effect. Most preferably, the poker 1 is made from ⅜ of an inch round stock cold roll steel.

In an embodiment of the present invention, it is envisioned that the entirety of the fire poker 1, i.e. the handle 3, the shaft 2, the hook member 4, all be molded or forged in a single unitary construction. This method of construction is advantageous as there are no extraneous parts that are required to be welded, tied, glued etc. to the shaft 2 of the poker 1, and thus, it will be difficult for any of these pieces to break off of the shaft 2. Loss of any of these parts will severely impede the usefulness of the poker 1.

The length of the shaft 2 of the poker 1 of the present invention can vary depending on the needs of the user. In particular, taller people may favour longer pokers 1, and thus, preferable embodiments are envisioned where the length of the shaft 2 is within the range of 24 inches to 48 inches. More preferably, the length of the shaft 2 is 27 to 44 inches, and most preferably, the shaft 2 is 34.5 inches. However, a poker 1 which has a shaft 2 of any feasible length falls within the scope of the present invention, i.e. a length of shaft 2 where a user is able to stand at a safe distance away from a fire and still be able to efficiently stoke the fire.

Figure 6:
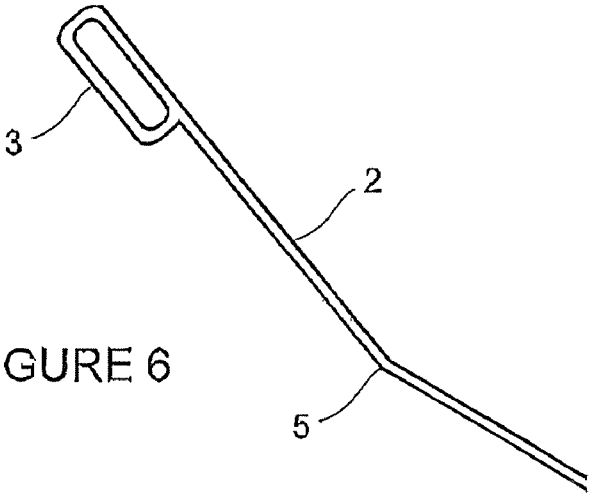
FIG. 6 is a side elevation view of an embodiment of a handle of the present invention.
Figure 7:
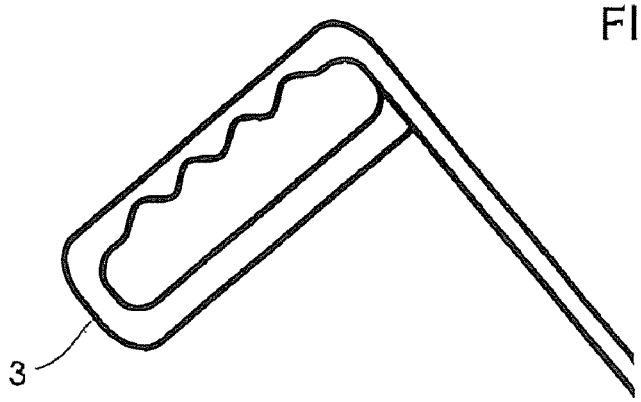
FIG. 7 is a side elevation view of another embodiment of a handle of the present invention.

Various embodiments have been envisioned with respect to a handle 3 for the fire poker 1. Any handle 3 as is known in the art can be utilized with the fire poker 1, while still residing within the scope of the present invention. However, in one embodiment, the handle 3 of the poker 1 is made of the same durable material as the rest of the poker 1, and is molded/forged directly onto the shaft 2 (see FIGS. 1, 6 and 8). As noted above, this provides for a handle 3 that is unlikely to break or fall of, as is possible in other pokers where the handle 3 is an extraneous piece of material that is attached to the poker 1 in some manner. Also, this shape of the handle 3 is designed for a more comfortable fit in the hand. From an ergonomic perspective, there is considerably less stress on the wrist. In particular, the handle 3 may be in the shape of what is typically called a "D" shaped handle 3 or a "U" shaped handle 3 (see FIGS. 1, 6 and 8). The exact dimensions of the handle 3 may vary, and in fact, numerous dimensions of the handle 3 are contemplated in order to provide a variety of handles 3 that will cater to the personal preferences and hand sizes of each individual user. The "D" or "U" shaped handle 3 design, when utilized in the poker 1, will also allow the poker 1 to be conveniently hung for storage purposes. For example, a hook fastened to a wall could be inserted into the handle 3, and the poker 1 will then be suspended on a wall until it is retrieved for further use.

In addition, it is also possible that the handle 3 portion of the shaft 2 is coated with rubber, or some equivalent type of material. This coating on the handle 3 will provide for an improved grip, and will also instill some level of insulation, in the case where the poker 1 becomes moderately warm.

A variation on the "D" or "U" shaped handle 3, which is contemplated within the scope of the present invention, is illustrated in FIG. 8. In this embodiment, the handle 3 has undulations which will provide for a handle 3 that can be more firmly and comfortably grasped by the hand of a user. This type of grip, sometimes also referred to as a "pistol grip", should allow the user to wield the poker 1 with more certainty.

Figure 5:
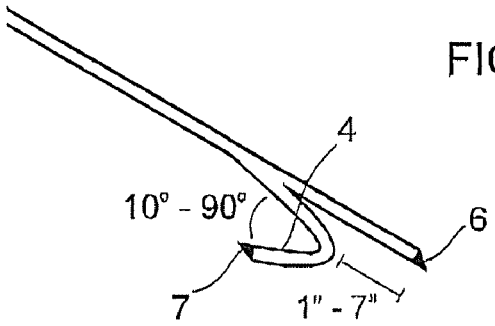
FIG. 5 is a side elevation view illustrating another embodiment of the present invention.

The end of the shaft 2 opposing the end that has a handle 3, has a hook member 4 extending from the shaft 2. Any hook member 4 that is known in the art is contemplated within the scope of the present invention. The hook member 4 should be configured in a way to allow for pulling and/or raking of the fuel of the fire. Preferably, the hook member 4 as illustrated in FIGS. 1, 5 and 8 is employed. This hook member 4 can be described as being a rounded "V" shaped hook member extending longitudinally from the shaft 2. The hook member 4 itself is preferably molded/forged directly to the shaft 2, and initially extends out of the shaft 2 in the direction of the shaft tip 6. At the apex of the rounded "V", the hook member 4 bends backward, substantially in the direction of the handle 3.

The hook member 4 can be in substantially the same plane as the "D" or "U" shaped handle 3, i.e. the hook member 4 and handle 3 extend from the same side of the shaft 2. However, it is also contemplated that the hook member 4 could also extend outward from the shaft 2 in a plane that is slightly offset from that of the shaft 2, or for that matter, the hook member 4 could also extend from the shaft 2 in any plane, relative to the handle 3, such as, for example, one that is perpendicular to that of the handle 3.

Preferably, the hook member 4 is located at a distance far enough from the shaft tip 6, such that when the user is stoking the fire intending to use only the shaft tip 6, the hook member 4 will not interfere with the intended result, i.e. the hook member 4 will not inadvertently touch, shift or relocate parts of the fire. To this end, it is contemplated that the apex of the rounded "V" shaped hook member 4 is about 1 to about 10 inches form the shaft tip 6, preferably the apex is about 1 to about 7 inches from the shaft tip 6. At this distance, when the user is prodding the fire with the shaft tip 6, the hook member 4 should be outside of the range where it will contact the fire.

The shaft tip 6 and the hook member tip 7 can each independently have a wide variety of finishes. It is contemplated that the shaft tip 6 and the hook member tip 7 may terminate with a flat blunt end, however, it is also within the scope of the present invention for one or both of these tips 6, 7 to have a rounded blunt end. Ideally, the tips 6, 7 will form some sort of edge, which will perform the function of momentarily grabbing, or grasping a log. To this end, the tips 6, 7 will be able to more easily manipulate the logs. Accordingly, it is preferred that the tips 6, 7 either have a pointed end or have a tapered edge. With respect to the hook member tip 7 and/or the shaft tip 6, it is most preferred that they have a 45° finished taper (see FIGS. 1, 2, 5, 8). The finished taper is advantageous A preferred embodiment of the present invention is depicted in FIG. 1. As can be seen, the handle 3 and the hook member 4 of the fire poker 1 are preferably located on precisely the same side of the shaft 2. In this embodiment, the shaft 2 comprises a single bend 5, which results in the handle 3 to extend away from the hook member 4.

In an embodiment of the present invention, it is envisioned that a portion or the entirety of the poker 1 may take on a colour aside from that ascribed to the material that comprises the poker 1 itself. The colour itself is not limited, but preferably, it is a colour that will draw attention to the poker 1, such that the poker 1 will be easy to find with the eyes. Preferably, vibrant and/or florescent colours are utilized in order increase visibility of the poker 1. This is beneficial for a variety of reasons. For example, if the poker 1 is primarily used in connection with outdoor firepits, the addition of colour to the poker 1 should make it easier to locate when light and visibility become limited. This will decrease time spent searching for the poker 1, and also could circumvent potential accidents, such as people tripping over the poker 1, which could happen if it is less visible and left in a precarious position.

Alternatively, if the poker 1 is to be primarily used in connection with indoor fireplaces, it might be more desirous that the colour of the poker 1 is more neutral, as opposed to a vibrant fluorescent colour. In particular, the poker 1 could be available in a wide array of colours that are likely to coincide with the varied tastes of consumers, having regard to home decor. This added flexibility in the colour scheme should increase the aesthetic appeal of the poker 1.

As noted above, the entire poker 1 does not need to take on a given colour to fall within the scope of the present invention.

In one embodiment, only the handle 3 of the poker 1 is coloured. In another embodiment, the handle 3 of the poker 1 and a portion of the shaft 2 up to the bend 5 is coloured. In a further embodiment, the handle 3 and the shaft 2, up to where the hook member 4 extends from the shaft 2, are coloured. In addition, it is also envisioned that various portions of the poker 1 could each take on a different colour.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A fire poker comprising:

an elongate shaft; a handle at one end of the shaft;

a longitudinal hook member near the second end of the shaft; wherein the shaft has a bend located at a position between the handle and the hook member, dividing the shaft into a handle portion and a hook portion, to facilitate efficient manipulation of fuel, wherein the hook member has a rounded "V" shape;

wherein the apex of the rounded "V" shaped hook member is located from about 1½ inch to about 7 inches from the tip of the second end of the shaft, and wherein the handle portion of the shaft is oblique with respect to the hook portion of the shaft.

2. The fire poker according to claim 1, wherein the section of the shaft that contacts the hook member is in the same plane as the section that contacts the handle.

3. The fire poker according to claim 1, wherein the section of the shaft that contacts the hook extends away from the section of the shaft that contacts the handle.

4. The fire poker according to claim 1, wherein the bend is located closer to the handle than to the hook member.

5. The fire poker according to claim 1, wherein the bend is located closer to the hook member than to the handle.

6. The fire poker according to claim 1, wherein the bend is substantially at the midpoint between the hook member and the handle.

7. The fire poker according to claim 1, wherein the end of the hook member points substantially in the direction of the handle.

8. The fire poker according to claim 1, wherein the bend causes the handle to extend away from the hook member.

9. The fire poker according to claim 1, wherein the handle is "D" shaped or "U" shaped.

10. The fire poker according to claim 1, wherein the handle and the hook member are located on the same side of the shaft.

11. The fire poker according to claim 1, wherein the handle is in the same plane as the hook member.

12. The fire poker according to claim 1, wherein the fire poker is of a single unitary construction.

13. The fire poker according to claim 1, wherein the bend is angled in the range of about 10 degree, to about 60 degree.

14. The fire poker according to claim 1, wherein at least one of the tip of the second end of the shaft and the tip of the end of the hook have an angled tapered finish.

15. The fire poker according to claim 1, wherein at least one of the tip of the second end of the shaft and the tip of the end of the hook are pointed.

16. The fire poker according to claim 1, wherein a portion of the poker has a fluorescent color.

* * * * *